United States Patent [19]

Bennett

[11] Patent Number: 4,479,514

[45] Date of Patent: Oct. 30, 1984

[54] FLOAT POSITIONING ASSEMBLY FOR PILOT OPERATED VALVE

[75] Inventor: Milton C. Bennett, Moline, Ill.

[73] Assignee: J. I. Case Company, Racine, Wis.

[21] Appl. No.: 386,122

[22] Filed: Jun. 7, 1982

[30] Foreign Application Priority Data

Apr. 18, 1981 [JP] Japan ..... 56-56001

[51] Int. Cl.[3] ..... F15B 13/042

[52] U.S. Cl. ..... 137/625.63; 137/625.64; 137/625.66; 91/464

[58] Field of Search ..... 91/464; 137/625.63, 137/625.64, 625.66, 625.69; 251/337

[56] References Cited

U.S. PATENT DOCUMENTS

| | | | |
|---|---|---|---|
| 2,949,097 | 8/1960 | Vander Kaay | 91/464 X |
| 4,011,891 | 3/1977 | Knutson et al. | 137/625.64 X |
| 4,024,798 | 5/1977 | Schexnayder et al. | 137/625.66 X |
| 4,182,534 | 1/1980 | Snyder | 137/596.14 X |
| 4,355,660 | 10/1982 | Huffman | 91/464 X |

*Primary Examiner*—Gerald A. Michalsky
*Assistant Examiner*—John C. Fox
*Attorney, Agent, or Firm*—Cullen, Sloman, Cantor, Grauer, Scott & Rutherford

[57] ABSTRACT

A float positioning assembly for servo actuated proportional control valves which increases the percentage of available pilot pressure for use during normal "raise" and "lower" modes of operation thereby saving energy. The float positioning assembly is connected to one end of a proportional control valve housing in axial alignment with a slidable valve spool. It includes a differential piston which is positioned between a centering spring assembly and an end member. The centering spring assembly includes a support member which is fixed at one end to the axially slidable control valve spool. A centering spring surrounds the support member, and it is mounted between a fixed collar and a slidable collar. When the valve spool is displaced for a "lower" mode of operation, the support member slidably moves through the slidable collar, and the centering spring is slightly compressed between the fixed and slidable collars. During such displacement, the differential piston remains in engagement with an annular abutment in the housing for the float positioning assembly. When the control valve spool is moved from the "lower" position to a "float" position, the differential piston is moved by the centering spring assembly against the end member of the float positioning assembly. There is no significant change in the differential pressure required to move the control valve spool between the "lower" position and the "float" position because the centering spring is merely carried along with the displaced centering spring assembly and differential piston. Thus, the float positioning assembly permits a relatively large percentage of available pilot pressure be used for proportional control in the normal "raise" and "lower" modes of operation.

1 Claim, 4 Drawing Figures

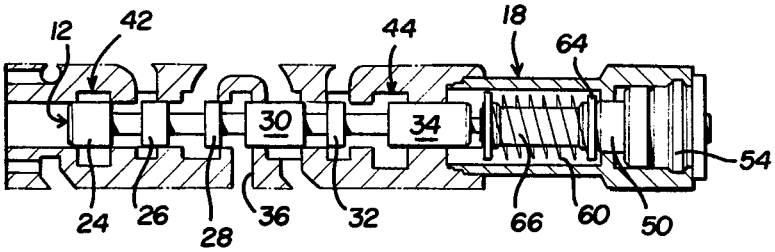
FIG. 3
FIG. 4
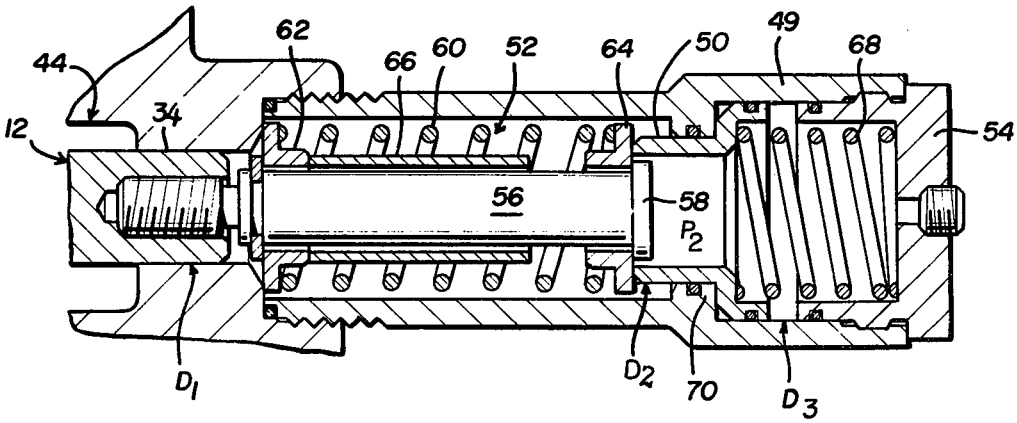

FLOAT POSITIONING ASSEMBLY FOR PILOT OPERATED VALVE

BACKGROUND OF THE INVENTION

The present invention relates to a float positioning assembly for pilot operated valves, and more particularly, to an assembly which permits a greater percentage of available pilot pressure to be used during "raise" and "lower" modes of operation, thereby saving energy.

It is known to provide servo actuated proportional flow control valves for operating double-acting cylinders, fluid motors and similar devices. A flow control valve of this type includes a pilot servo actuator which effects axial movement of a valve spool to control fluid flow to the double-acting cylinder. The valve spool is movable by the servo actuator from a "neutral" position to either a "raise" or "lower" position depending upon the directional movement desired for the double-acting cylinder.

In many applications, it is necessary for the valve spool of the flow control valve to have an additional "float" position where the two working ports of the control valve are both simultaneously connected to a tank or reservoir. This is necessary so that an attachment that is connected to the double-acting cylinder may freely position itself in accordance with the forces acting upon it. The "float" position is typically located at one extreme end of the valve spool stroke, and the spool travel from the "neutral" position to the "float" position is approximately twice the spool travel from the "neutral" position to the "lower" position. In known proportional control valves, the valve spool is movable against a fixed position centering spring which returns the valve spool to a "neutral" position when the pilot servo actuator is not being operated.

For a pilot operated valve of the proportional electro-hydraulic type, the pilot pressure required to move the valve spool between the "neutral" and "float" positions is approximately twice the pilot pressure required to move the valve spool between the "neutral" and "lower" positions using a conventional centering spring arrangement. Thus, there has been a need for a device which will permit a much greater percentage of available pilot pressure to be used for proportional control in the normal "raise" and "lower" modes of operation and still return the valve spool to its "neutral" position if an electrical or hydraulic failure occurs.

SUMMARY OF THE INVENTION

In accordance with the present invention, a float positioning assembly is provided for servo actuator proportional control valves which increases the percentage of available pilot pressure for use during normal "raise" and "lower" modes of operation, thereby saving energy.

The conventional proportional flow control valve illustrated herein includes an axially slidable valve spool which is displaced to "neutral", "raise", "lower" and "float" positions by a pilot servo actuator. This controls fluid flow from a hydraulic pump to a double-acting hydraulic cylinder to actuate or operate the latter to perform a function.

The float positioning assembly of the present invention is connected to one end of the proportional control valve housing in axial alignment with the slidable valve spool. It includes a differential piston which is positioned between a centering spring assembly and an end member.

The centering spring assembly includes a support rod which is fixed at one end to the axially slidable control valve spool with an enlarged abutment at its opposite end. A centering spring surrounds the support rod, and it is mounted between a first collar and a second slidable collar. The first collar includes a sleeve which comes into engagement with the slidable collar when the control valve spool is linearly displaced to "lower" and "float" positions.

A spring having a low spring rate is located between the end member and differential piston to initially locate the differential piston against an interior annular abutment within the housing for the float positioning assembly.

When the valve spool is displaced for a "lower" mode of operation, the support rod for the centering spring assembly slidably moves through the slidable collar and the first collar sleeve is brought into engagement against the slidable collar thereby compressing the centering spring between the first collar and slidable collar. During such displacement, the differential piston remains in engagement with the annular abutment in the housing for the float positioning assembly. This occurs because the differential piston has a greater cross-sectional area than the cross-sectional area of the control valve spool, and therefore, the fluid pressure acting upon the differential piston produces a greater force than the force produced by the fluid pressure which acts upon the opposite end of the control valve spool.

If the control valve spool is moved from the "lower" position to a "float" position, the differential piston is moved by the centering spring assembly against the end member of the float positioning assembly. However, there is no significant change in the differential pilot pressure required to move the control valve spool between the "lower" position and the "float" position because the centering spring has already been compressed and is merely carried along with the displaced centering spring assembly and differential piston. Thus, the float positioning assembly permits a relatively large percentage of available pilot pressure to be used for proportional control in the normal "raise" and "lower" modes of operation thereby saving energy. If there is an electrical or hydraulic failure in the system, the centering spring is compressed sufficiently to return the control valve spool to its neutral position.

Other advantages and meritorious features of the float positioning assembly of the present invention will be more fully understood from the following description of the preferred embodiment, the appended claims, and the drawings, a brief description of which follows.

BRIEF DESCRIPTION OF DRAWINGS

FIG. 3 is a schematic illustration of the control valve spool and float positioning assembly in a "float" position.

FIG. 4 is an enlarged cross-sectional view of the float positioning assembly of the present invention.

DETAILED DESCRIPTION OF THE INVENTION

A preferred embodiment of the float positioning assembly for pilot operated valves of the present invention is illustrated in FIGS. 1–4.

Figure 1:
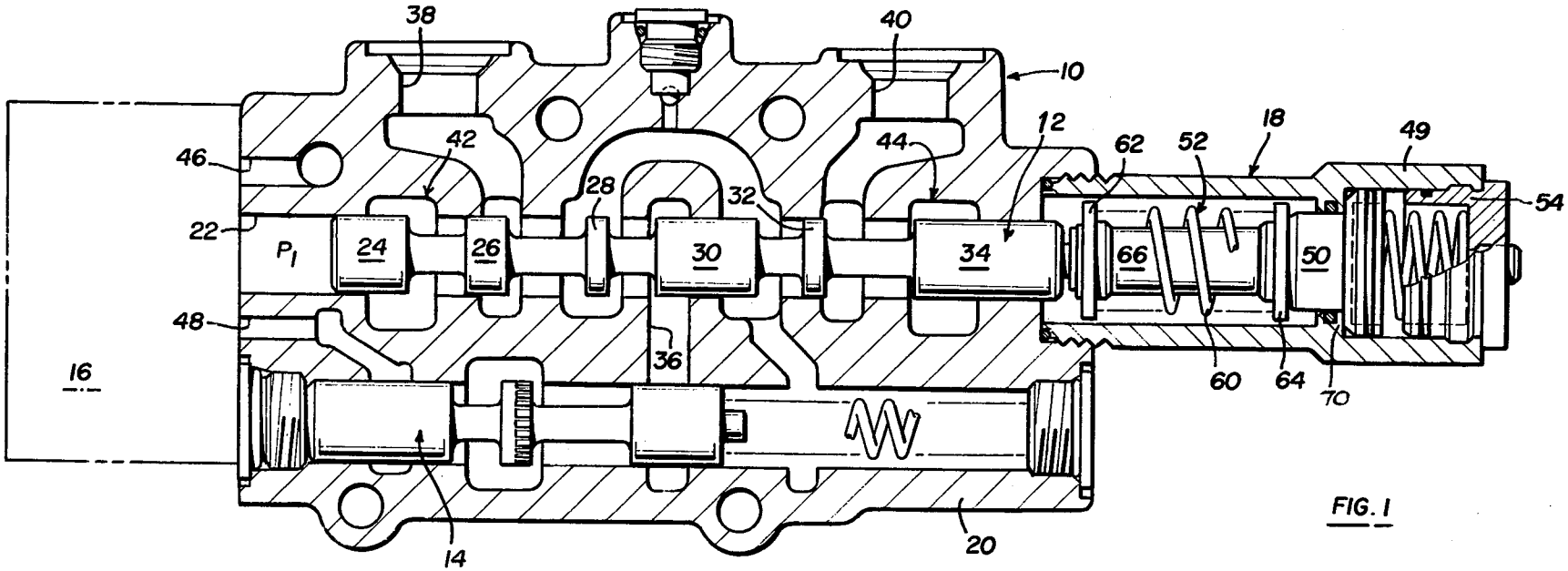
FIG. 1 is a side elevational view, in cross-section, of a servo actuator proportional control valve including the float positioning assembly of the present invention.

FIG. 1 illustrates a proportional flow control valve 10 which controls fluid flow from a hydraulic pump (not shown) to a double-acting hydraulic cylinder (not shown) to actuate or operate the latter to perform a function. Control valve 10 comprises a directional control valve spool 12, a flow controlling spool 14, an electro-hydraulic pilot actuator 16, and a float positioning assembly 18 made in accordance with the teachings of the present invention. The construction and operation of the control valve 10 and actuator 16 are conventional and the invention herein resides in the float positioning assembly 18.

Control valve 10 includes a housing 20 having a bore 22 therein in which axially slidable valve spool 12 is located. Spool 12 is provided with axially spaced apart lands 24, 26, 28, 30, 32 and 34. Valve housing 20 includes a fluid line 36 to which inlet fluid is directed from the pump (not shown) through interior porting. A pair of outlet ports 38 and 40 from housing 20 are connected to a double-acting hydraulic cylinder (not shown) and a pair of outlet ports 42 and 44 are connected to a tank or reservoir (not shown).

Pilot actuator 16 is secured in sealed relationship to valve housing 20, and it is a bi-directional actuator which produces a linear output displacement which is proportional to the magnitude and polarity of an electrical signal. As is conventional, the pilot actuator 16 causes a corresponding linear displacement of control valve spool 12 by means of pressure $P_1$ being applied against the left end of spool 12 or a pressure $P_2$ (FIG. 4) being applied against the right end of spool 12 through an internal passage (not shown). Pilot supply and return pressures are communicated to and from actuator 16 through passages 46 and 48. Again, actuator 16 and the basic elements of control valve 10 are conventional in construction and operation and by themselves form no part of the present invention.

Figure 2:
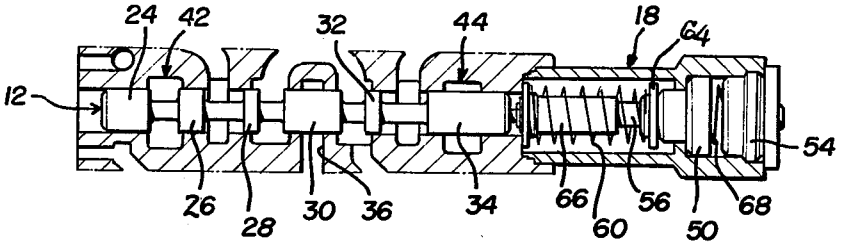
FIG. 2 is a schematic illustration of the axially slidable control valve spool and float positioning assembly in a "neutral" position.

FIG. 2 shows spool 12 of control valve 10 in a null or "neutral" position wherein the hydraulic cylinder outlet ports 38 and 40 are both closed. FIG. 1 shows spool 12 moved to the right wherein outlet port 38 is open to line 36 and port 40 is open to reservoir port 44 thereby causing the piston of the hydraulic cylinder (not shown) to move in a first direction. Similarly, spool 12 may be moved to the left where outlet port 38 is open to reservoir port 42 and port 40 is open to line 36 thereby causing the piston of the hydraulic cylinder (not shown) to move in a second direction. The just described movements of spool 12 result in what is commonly referred to as the "neutral", "lower", and "raise" modes of operation for a hydraulic cylinder that is connected to control valve 10.

In many applications, it is necessary for the main spool 12 to have a "float" position as shown in FIG. 3 where the two working ports 38 and 40 are both simultaneously connected to return or reservoir ports 42 and 44. The "float" position, as illustrated in FIG. 3, is preferably located at one extreme end of the stroke for valve spool 12. The total spool movement from "neutral" (FIG. 2) to the "float" position (FIG. 3) is typically twice the movement from "neutral" to the "lower" position (FIG. 1). Thus, for a pilot operated valve such as control valve 10, this means that approximately twice the pilot pressure to obtain the "lower" position of spool 12 is required to obtain the "float" position if a conventional centering spring arrangement were used.

The float positioning assembly 18 of the present invention is housed in a separate housing 49 and includes a differential piston 50 which is positioned between a centering spring assembly 52 and an end member 54. The centering spring assembly includes a support rod 56 which is fixed at one end to piston 34 with an enlarged abutment 58 at its opposite end. Centering spring 60 surrounds rod 56 and is mounted between first collar 62 and slidable collar 64. First collar 62 includes a sleeve 66 which comes into engagement with collar 64 when spool valve 12 is linearly displaced to the "lower" and "float" positions shown in FIGS. 1 and 3, respectively. A spring 68 having a very low spring rate is located between end member 54 and differential piston 50 to initially locate piston 50 against abutment 70.

As described, FIG. 2 illustrates valve spool 12 in a null or "neutral" position wherein the hydraulic cylinder outlet ports 38 and 40 are both closed. When spool 12 is in a "neutral" position as shown, the pressures $P_1$ and $P_2$ (FIGS. 1 and 4) against the opposite ends of spool 12 are equal such that centering spring 60 remains in the position shown in FIG. 2. There is no differential pilot pressure acting across valve spool 12 (i.e., $P_1-P_2=0$).

As is conventional, pilot actuator 16 is capable of producing an increase in pressure $P_1$ and decrease in pressure $P_2$ for displacing spool 12 to the right when it is desired to open port 38 to line 36 and open port 40 to reservoir port 44 during a "lower" mode of operation. FIG. 1 illustrates the location of the various elements when valve spool 12 has been displaced for the "lower" mode of operation.

During such displacement, shaft 56 slidably moves through collar 64 and sleeve 66 is brought into engagement against collar 64. Differential piston 50, however, remains in engagement against abutment 70 as shown in FIG. 1 because the pressure $P_2$ acting over the annular area between $D_2$ and $D_3$ (FIG. 4) produces a greater force than the force produced by pressure $P_1$ acting against the left end of spool 12. That is, the annular cross-sectional area between $D_2$ and $D_3$ is approximately twice the cross-sectional area $D_1$ (FIG. 4) of spool 12. Thus, centering spring 60 is compressed slightly between collars 62 and 64 during its travel to the right from the "neutral" position of FIG. 2 to the "lower" position of FIG. 1.

Valve spool 12 is further movable to a "float" position as shown in FIG. 3 by increasing pressure $P_1$ and decreasing pressure $P_2$ which causes differential piston 50 to be moved by centering spring assembly 52 against end member 54. There is no significant change in the differential pilot pressure required (i.e., $P_1-P_2$) to move spool 12 between the "lower" position of FIG. 1 and the "float" position of FIG. 3 because the centering spring 60 has already been compressed and is merely carried to the right with spring assembly 52 and differential piston 50. Thus, float positioning assembly 18 permits a relatively large percentage of available pilot pressure to be used for proportional control in the normal "raise" and "lower" modes of operation thereby saving energy. If there is an electrical or hydraulic failure in this system, centering spring 60 is compressed sufficiently to return spool 12 to its "neutral" position.

It will be apparent to those skilled in the art that the foregoing disclosure is exemplary in nature rather than limiting, the invention being limited only by the appended claims.

I claim:

1. In a proportional flow control valve including an axially slidable valve spool which is displaced to a plurality of positions by a pilot servo actuator for controlling fluid flow from a pump to a double-acting hydraulic cylinder to actuate the hydraulic cylinder for performing a function, the improvement comprising:

a float positioning assembly connected to said flow control valve in axial alignment with said slidable valve spool, said float positioning assembly including a differential piston which is positioned between a centering spring assembly and a stop member within a housing, and wherein the cross-sectional area of said differential piston being greater than the cross-sectional area of said valve spool;

said centering spring assembly including an elongated rod-like support member which is secured at one end to said axially slidable valve spool, said support member having an enlarged abutment at its opposite end which is movable within an opening through said differential piston, a centering spring surrounding said support member, said centering spring being mounted between a first collar which is mounted on said support member adjacent to its one end and a slidable collar which is slidably movable on said support member against said enlarged abutment and against said differential piston;

a spring having a low spring rate located between said stop member and said differential piston to initially locate said differential piston in engagement against an interior annular abutment within said housing;

said valve spool being linearly displaced to a first position for compressing said centering spring between said first and slidable collars and said differential piston remaining in engagement against said abutment, and wherein said first collaar includes a sleeve and said centering spring surrounding said sleeve, said sleeve being movable into engagement with said slidable collar when said valve spool is linearly displaced to said first position; and said valve spool being linearly displaced to a second position beyond said first position with said differential piston being moved by said centering spring assembly against said stop member and said centering spring being carried with said displaced centering spring assembly and differential piston.

* * * * *